United States Patent [19]

Beerens

[11] Patent Number: 4,557,054

[45] Date of Patent: Dec. 10, 1985

[54] CHAIN SAW BAR

[76] Inventor: Cornelis J. M. Beerens, 40-42 Berkshire Rd., North Sunshine, Victoria, Australia

[21] Appl. No.: 552,058

[22] PCT Filed: Feb. 16, 1983

[86] PCT No.: PCT/AU83/00021

§ 371 Date: Oct. 13, 1983

§ 102(e) Date: Oct. 13, 1983

[87] PCT Pub. No.: WO83/02916

PCT Pub. Date: Sep. 1, 1983

[30] Foreign Application Priority Data

Feb. 17, 1982 [AU] Australia ..... 2746/82

[51] Int. Cl.[4] ..... B27B 17/02

[52] U.S. Cl. ..... 30/384; 30/387

[58] Field of Search ..... 30/383–386; 83/820, 825, 826; 474/140, 165, 199; 308/189 R, 233

[56] References Cited

U.S. PATENT DOCUMENTS 2,929,092 3/1960 Carpenter ..... 308/189 R X 3,995,370 12/1976 Allard et al. ..... 30/382

FOREIGN PATENT DOCUMENTS 753084 2/1967 Canada ..... 30/385

*Primary Examiner*—Douglas D. Watts

*Attorney, Agent, or Firm*—Wigman & Cohen

[57] ABSTRACT

A chain saw bar having a central groove along the top and bottom edges to guide the chain about the bar, and a bar nose structure at the end of the bar to guide the chain from the top edge to the bottom edge. The nose structure including an extension of the bar on one side of the groove and a roller rotatably mounted on the extension to form the other side of the groove at the nose of the bar. The roller and extension having arcuate peripheral faces to guide the chain about the nose of the bar.

17 Claims, 9 Drawing Figures

1
2
2A
3
4
5
5B
6
7
7A
7B
9
10
11
15
40
45
46
47
48
49
51
52
53
55
56
4A
5A

CHAIN SAW BAR

This invention relates to a bar for a chain saw of the type having a peripheral groove in which the tongues of the chain are guided, and faces on either side of the groove to support the chain as it travels around the periphery of the bar.

Various constructions of chain saws bars are known wherein the nose portion of the bar incorporates a roller or sprocket rotatably mounted to guide the chain as it passes from the top edge to the bottom edge of the bar. The provision of the roller or sprocket reduces the wear on the chain and wear on the nose portion of the bar. In these known constructions the bearing supporting the roller or sprocket is usually of an axial length equal to the width of the groove in the edge face of the bar. This restriction on the bearing size limits the effective life of the bearing.

Because of the restriction on the axial length of the bearing, the diameter of the bearing should be reasonably large to provide a bearing that has a satisfactory working life. It will be appreciated that the diameter of the bearing influences the diameter of the sprocket or roller, and as the bearing diameter increase so does the nominal diameter of the roller or sprocket and so the radius of the path of the chain around the nose of the bar is also increased.

It is a recognised fact that the severity of kick-back during operation of a chain saw is increased with increases in the radius of the path of the chain around the nose. Accordingly from the point of view of safety, the nominal diameter of the roller or sprocket should be kept small. Thus the sprocket or roller diameter should be increased to improve bearing life, and should be reduced to improve safety by reducing the severity of kick-back. Accordingly in the known designs, a compromise must be made between bearing life and safety.

It is the object of the present invention to provide a bar for a chain saw incorporating a structure at the nose of the bar that will permit a bearing of the larger size to be incorporated, thus have a longer effective life, without the need for a corresponding increase in the sprocket or roller nominal diameter.

According to the invention there is provided a chain saw bar having top and bottom longitudinal edge faces along which the chain travels and a central longitudinal groove in said edge faces to receive drive tongues of the chain, and a bar nose structure at the foreward end of the bar to guide the chain from the top to the bottom edge face of the bar, said nose structure comprising an extension of the bar of less thickness than the bar and having one side face substantially co-extensive with a side wall of the groove in the bar, a roller supported for rotation by a bearing structure mounted on said extension, said roller providing an arcuate surface to guide the chain from the top to the bottom edge face of the bar and defining with the extension a groove to receive the chain drive tongues.

Conveniently the extension is of a thickness equal to the distance from said wall of the groove to the side face of the bar adjacent said wall. In this way the face of the extension, which defines with the roller the groove at the nose of the bar, is co-extensive with the internal face of the groove in the edge of the bar. Preferably the roller may incorporate a sprocket tooth formation, that is located in the groove formed by the roller and the extension, to co-operate with the chain in the conventional manner as the chain passes around the nose of the bar. The sprocket teeth may be formed on a member that is attached to the roller to rotate therewith, or may be formed integral with the roller.

As the sprocket is attached to or integral with the roller, the total thickness is increased and the diameter of the sprocket may be smaller than possible in a conventional sprocket constuction.

The nose structure of the bar enables the roller to be of a greater axial length than in previously known constructions, and therefore the bearing may also be of greater axial length than the width of the bar edge groove, which was the limiting factor in prior constructions, and hence greater bearing area and longer life is obtained. As the increase in bearing area is achieved by an increase in length rather than diameter of the bearing, a longer bearing life is achieved without a reduction in safety. Also if desired a smaller diameter roller may be used, without encountering a reduction in bearing life, and the smaller diameter contributes to increased safety by reducing the risk of and/or severity of kick-back.

A further problem with the currently used constructions of roller nose bars is the interruption in the surface that supports the chain, between the front ends of the top and bottom bar edges and the peripheral surface of the roller. The absence of support for the chain as it passes over these interruptions results in additional wear, particularly on the bottom edge of the bar where the chain passes from the circular periphery of the roller onto the straight edge face of the bar.

The bar of the present invention enables this problem to be substantially reduced as the extension may be shaped to provide a continuous support surface for the links on one side of the chain as the links on the other side pass from the bar edge to the periphery of the roller and vice-versa. A considerable reduction in wear on the bar is thus achieved.

The bearing structure may comprise a conventional needle roller bearing located between the internal surface of an axial bore in the roller and the external surface of a boss projecting from the bar extension. The boss may be formed integral with the bar extension or attached thereto by welding, riveting, screwing or other suitable means. A retainer plate may be provided to be received in a recess in the exposed surface of the roller, and secured to the boss, to provide a cover for the needle rollers of the bearing, and retain the roller in assembly with the needle rollers and the boss. The retainer plate may be secured in position by the same rivets or fastening that hold the boss in assembly with the bar extension. Alternatively the retainer plate may be screw threaded onto the end of the boss.

The invention will be more readily understood from the following description of several practical arrangements of the chain saw bar incorporating a roller nose construction of the present invention as illustrated in the accompanying drawings.

Figures 1, 2, 4:
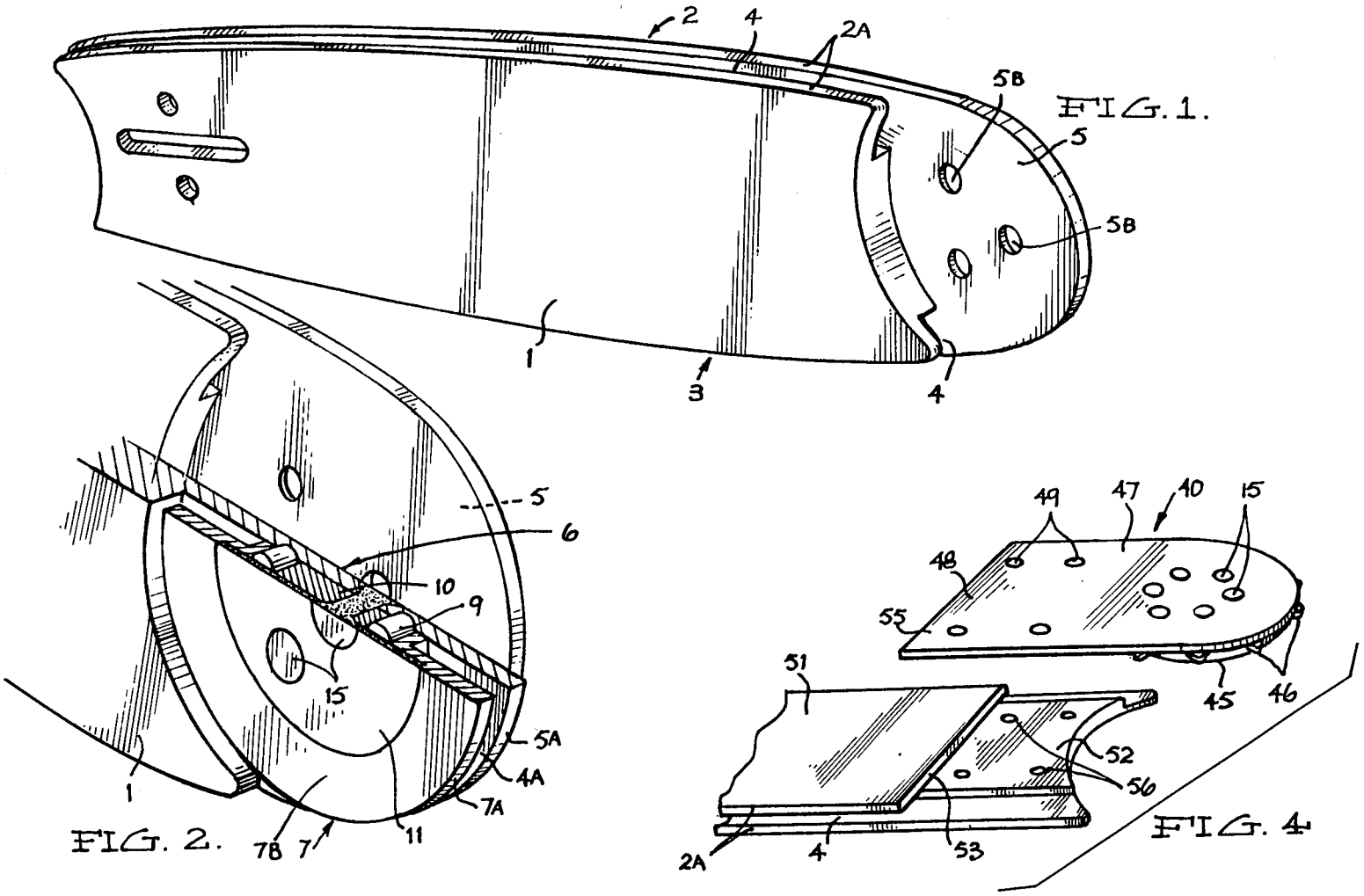
FIG. 1 is a perspective view of one embodiment of the chain saw bar with the roller removed.
FIG. 2 is a partial longitudinal sectional view of the bar shown in FIG. 1 with the roller attached.
FIG. 4 is an exploded view of portion of a chain saw bar having a detachable nose structure.

Referring now to the accompanying drawings, the chain saw bar 1 shown in FIG. 1 has along the upper and lower edge faces 2 and 3 a longitudinal extending groove 4 to receive the drive tongues of a conventional chain. The extension 5 of the bar 1 is of the same thickness as the land 2A on one side of the groove 4, and has holes 5B to receive rivets to secure thereto a bearing structure 6 which rotatably supports the roller 7 as shown in FIG. 2. The needle rollers 9 are located within a central bore in the roller 7 about the boss 10 and retained therein by the retaining plate 11. The retaining plate 11 and the boss 10 are held in assembly with the bar extension 5 by rivets 15. In a modification, not illustrated, the retaining plate 11 is formed integral with the boss 10 and the integral component is secured to the extension by rivets as in FIG. 2.

The forward end of the extension 5 has a substantially semi-circular shape with axis thereof on the axis of the roller 7.

As the chain passes around the nose of the bar 1, the links on one side of the chain are supported on the edge surface 5A of the extension, and the links on the other side of the chain are supported on the peripheral surface 7A of the roller 7. The drive tongues of the chain are located in the groove 4A formed between extension 5 and the flange 7B of the roller 7.

Figure 3:
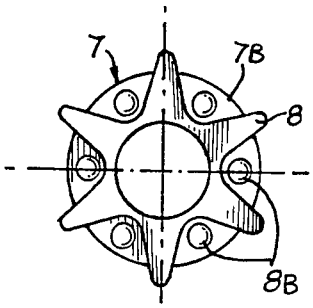
FIG. 3 is a side view of a modified roller incorporating a sprocket suitable for use in the bar shown in FIG. 1, viewed from the sprocket side.

The roller shown in FIG. 3 is basically the same as that in FIG. 2 with the addition of toothed sprocket 8, what will be located in the groove 4A formed between the roller flange 7B and the bar extension 5 when in use. This sprocket is attached to, or formed integral with (as shown), the roller so as to rotate therewith. The series of holes 8B are provided in the flange 7B of the roller to clear chips from between the sprocket teeth.

It is to be understood that the peripheral surface of the roller may be shaped to further reduce the likelihood and severity of kick-back from the chain as it passes around the nose structure. The shape of the peripheral edge of the roller may be any one of the roller shapes described in more detail in my co-pending U.S. Patent Application Ser. No. 409,308 or other suitable forms.

Figure 5:
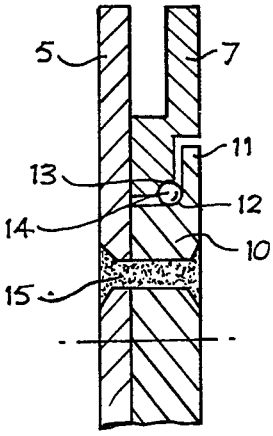

In the alternative construction shown in FIG. 5, an angular contact ball bearing structure is used to support the roller 7 on the boss 10. The boss and retaining plate 11 are of a unit construction with the arcuate ball seat 12 formed at the internal junction therebetween. The complementary angular seat 13 is formed on the roller 7 and a plurality of ball bearings 14 are seated in the seats 12 and 13 to rotatably support the roller 7. The boss and retaining plate unit is secured by rivets to the extension 5.

Figure 6:
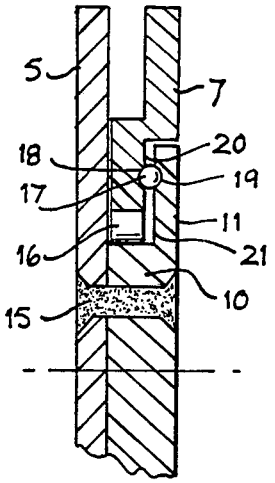
FIGS. 5, 6 and 7 show fragmentary sections of the nose structure with alternative bearing arrangements for supporting the roller.

In the construction shown in FIG. 6, a plurality of needle rollers 16 are located between the roller 7 and boss 10, and a plurality of ball bearings 17 are seated in complementary annular grooves 18 and 19 provided in opposed radial faces 20 and 21 of the roller and retaining plate 11 respectively. Again the retaining plate and boss are formed integral and secured to the extension 5 by the rivets 15.

Figure 7:
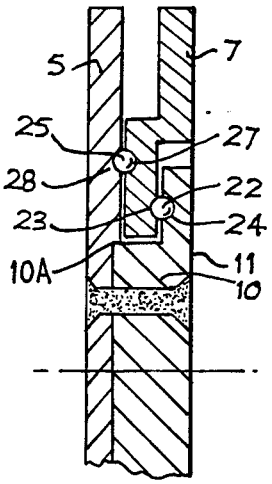

Another form of bearing construction is shown in FIG. 7 wherein two sets of ball bearings are used. The ball bearings 22 are seated in complementary annular grooves 23 and 24 in the one side of the roller and the retaining plate. The other set of ball bearings 25 are located in complementary annular grooves 27 and 28 in the opposite side of the roller 7 and the extension 5, and are spaced radially from the ball bearings 22. In this construction the boss 10 is spigoted at 10A into a recess in the extension 5, and again held in assembly by rivets 15.

Figure 8:
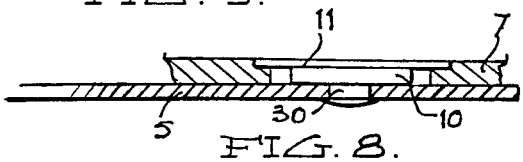
FIGS. 8 and 9 show fragmentary sections of the nose structure with alternative means of attaching the boss and retaining plate unit to the bar extension.
Figure 9:
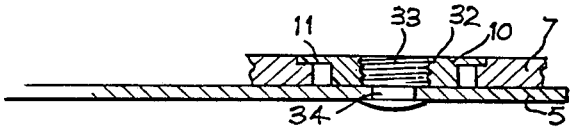

In FIG. 8, the boss 10 and retaining plate 11 are of an integral construction, with a spigot 30 integral with the boss. The spigot 30 passes through an aperture in the extension 5 and is riveted over against the outer face of the extension 5. In another modification shown in FIG. 9, the integral boss and retaining plate has a thread hole 32 co-axial with the boss 10. The threaded stud 33 is secured to the extension 5, and threadably engages the hole 32 to maintain the bar and retaining plate assembled to the extension 5. As shown in FIG. 9, the threaded stud 33 has a spigot 34 that passes through the hole in the extension 5 and is riveted over on the outside of the extension 5. The threaded stud may be secured to the extension by other suitable means if desired.

FIG. 4 illustrates a bar construction having a detachable nose structure 40. The nose structure includes a roller 45 with an integral sprocket 46 as previously described. The roller may be rotatably mounted on the extension member 47 by any one of the various constructions previously described. The extension member 47 has a mounting portion 48 with four holes 49 to receive attaching rivets.

The bar 51 has a portion cut away on one side to form a mounting face 52 and a shoulder 53. The extension member 47 is assembled in face to face relationship with the mounting face 52 with the end edge 55 of the mounting portion 48 abutting the shoulder 53. When so assembled, the holes 49 align with the holes 56 in the bar to receive rivets to secure the nose structure 40 to the bar 1.

In use the nose portion of a chain saw bar is more subject to wear than the remainder of the bar, and so by making the nose portion detachable, it may be replaced when it is worn. Replacement of the nose portion only is less expensive than replacement of the complete bar including a nose roller or sprocket.

The claims defining the invention are as follows:

I claim:

1. A chain saw bar having top and bottom longitudinal edge faces along which the chain travels and a central longitudinal groove in said edge faces having opposite side walls to receive drive tongues of the chain, and a bar nose structure at the forward end of the bar to guide the chain from the top to the bottom edge face of the bar, said nose structure comprising an extension of the bar of less thickness than the bar and having one side face coplanar with one side wall of the groove in the bar, a roller supported for rotation by a bearing structure mounted on said extension, said roller having a radial surface substantially co-planar with the other side wall of the groove and defining with said one side wall of the extension a groove to receive the chain drive tongues and guide the chain as the chain travels from the top to the bottom edge face of the bar;

whereby an inner edge of the chain is guided around the nose by a circumferential edge of the roller and a circumferential edge of the extension.

2. A chain saw bar having respective opposite side faces, and top and bottom longitudinal edge faces extending between the side faces, a central longitudinal groove in each edge face having opposite side walls and to receive drive tongues of a chain, and a bar nose structure at the forward end of the bar to guide the chain from the top to the bottom edge face of the bar, said nose structure comprising an extension of the bar having one face substantially co-extensive with one side face of the bar and an opposite face coplanar with the side wall of the groove adjacent said one side face of the bar, and a roller supported by a bearing structure mounted on the extension for rotation, said roller having a radial surface portion in a plane parallel to said opposite face of the extension and defining with said opposite face a groove as a continuation of the grooves in said edge faces of the bar, the roller and the extension having respective arcuate peripheral surfaces to guide and support an inner edge of the chain from the top to the bottom edge face of the bar.

3. A chain bar as claimed in claim 1 or 2 wherein a plurality of sprocket teeth are located in said groove in the roller, said sprocket teeth being supported by the roller to rotate therewith, said teeth being adapted to engage with the chain as it passes around the nose structure.

4. A chain saw bar as claimed in claim 3 wherein the sprocket teeth are formed integral with the roller.

5. A chain saw bar as claimed in claim 3 wherein the bearing structure comprises a boss non-rotatably attached to the extension and extending into a central bore in the roller, and a plurality of rollers operatively interposed between the boss and the bore.

6. A chain saw bar as claimed in claim 5 wherein a retaining plate is integral with or secured to the boss and adapted to retain the roller and the rollers in assembly with the boss.

7. A chain saw bar as claimed in claim 6 wherein a plurality of balls are operatively interposed between the roller and the retaining plate to provide a bearing to support the roller in the radial and axial direction.

8. A chain saw bar as claimed in claim 1 or 2 wherein the bearing structure comprises two ball bearing assemblies, one bearing assembly operatively interposed between the extension and the roller and the other bearing assembly operatively interposed between the roller and a retaining plate secured to the extension on the side of the roller axially spaced from the extension.

9. A chain saw bar as claimed in claim 1 or 2 wherein the nose structure is constructed as a replaceable unit attached to the bar.

10. A chain saw bar having top and bottom longitudinal edge faces along which a chain travels and a central longitudinal groove in said edge faces having opposite side walls to receive drive tongues of the chain, wherein at the forward end of the bar an extension of the bar of less thickness than the bar and having one side face coplanar with a side wall of the groove in the bar, so that a roller may be supported for rotation by a bearing structure mounted on said extension, said roller when so supported providing with the extension an arcuate surface to guide an inner edge of the chain from the top to the bottom edge face of the bar and defining a groove having opposite side walls co-planar with the opposite side walls of the central longitudinal groove to receive the chain drive tongues.

11. For attachment to a chain saw bar having a top and bottom longitudinal edge faces along which the chain travels and a central longitudinal groove in said edge faces having opposite side walls to receive drive tongues of the chain, and at the forward end of the bar an extension of the bar of less thickness than the bar and having one side face coplanar with a side wall of the groove in the bar; a roller and a bearing structure adapted for attachment to said extension to rotatably support the roller so that when so attached the roller and the extension provide an arcuate surface to guide an inner surface of the chain from the top to the bottom edge face of the bar and the roller and extension define a groove having opposite side walls co-planar with the opposite side walls of the central longitudinal groove to receive the chain drive tongues.

12. A chain saw bar as claimed in claim 3 wherein the bearing structure comprises a boss non-rotatably attached to the extension and extending into a central bore in the roller, and a plurality of rollers operatively interposed between the boss and the bore.

13. A chain saw bar as claimed in claim 3 wherein the bearing structure comprises two ball bearing assemblies, one bearing assembly operatively interposed between the extension and the roller and the other bearing assembly operatively interposed between the roller and a retaining plate secured to the extension on the side of the roller axially spaced from the extension.

14. A chain saw bar as claimed in claim 12 wherein the nose structure is constructed as a replaceable unit attached to the bar.

15. A chain saw bar, comprising:

top and bottom longitudinal edge faces along which an inner surface of a chain travels; and a central longitudinal groove in said edge faces having opposite side walls and to receive drive tongues of the chain;

at the forward end of the bar an extension of the bar of less thickness than the bar and having one side face coplanar with one of said side walls of the groove in the bar, said extension being adapted so that a roller may be supported for rotation by a bearing structure mounted on said extension, said roller when so supported providing with the extension a peripheral surface to guide the inner surface of the chain from the top to the bottom edge face of the bar and a radial surface defining with the one side face of the extension of the bar a groove to receive the chain drive tongues.

16. An attachment to a chain saw bar having top and bottom longitudinal edge faces along which an inner surface of a chain travels and a central longitudinal groove in said edge faces having opposite side walls and to receive drive tongues of the chain, and at the forward end of the bar an extension of the bar of less thickness than the bar and having one side face coplanar with one of said side walls of the groove in the bar, said attachment comprising:

a roller and a bearing structure adapted for attachment to said extension to rotatably support the roller so that when so attached the roller and extension provide a peripheral surface to guide the inner surface of the chain from the top to the bottom edge face of the bar and a radial surface coplanar with the other of said side walls to define with the extension a groove to receive the chain drive tongues.

17. A chain saw bar, comprising:

top and bottom longitudinal edge faces along which an inner surface of a chain travels;

a central longitudinal groove in said edge faces having opposite side walls to receive drive tongues of the chain; and a bar nose structure at the forward end of the bar to guide the chain from the top to the bottom edge faces of the bar;

said nose structure comprising an extension of the bar of less thickness than the bar and having one side face coplanar with one side wall of the groove in the bar, a roller supported for rotation by a bearing structure mounted on said extension, said roller having a peripheral surface coaxial with the axis of rotation of the roller which together with a peripheral surface of the extension supports and guides the inner surface of the chain from the top to the bottom edge face of the bar and a radial surface substantially co-planar with the other side wall of the groove and defining with the extension a groove to receive the chain drive tongues as the chain travels from the top to the bottom edge face.

* * * * *

UNITED STATES PATENT AND TRADEMARK OFFICE

CERTIFICATE OF CORRECTION

PATENT NO. : 4,557,054

DATED : December 10, 1985

INVENTOR(S) : CORNELIS JOHANNES MARIA BEERENS

It is certified that error appears in the above—identified patent and that said Letters Patent is hereby corrected as shown below:

Column 5, line 19, insert --saw-- after "chain".

Column 5, line 65, delete "a", second occurrence.

Signed and Sealed this

*Eighteenth* Day of *February 1986*

[SEAL]

*Attest:*

DONALD J. QUIGG

*Attesting Officer*

*Commissioner of Patents and Trademarks*